United States Patent [19]

Svoboda et al.

[11] 4,166,636

[45] Sep. 4, 1979

[54] SKI BINDING PART

[75] Inventors: Josef Svoboda, Schwechat; Karl Stritzl, Vienna, both of Austria

[73] Assignee: TMC Corporation, Baar, Switzerland

[21] Appl. No.: 786,390

[22] Filed: Apr. 11, 1977

[30] Foreign Application Priority Data

Apr. 14, 1976 [AT] Austria ..... 2721/76

[51] Int. Cl.[2] ..... A63C 9/08

[52] U.S. Cl. ..... 280/625

[58] Field of Search ..... 280/625

[56] References Cited

U.S. PATENT DOCUMENTS

| | | | |
|---|---|---|---|
| 3,232,631 | 1/1966 | Witschard | 280/625 |
| 3,380,750 | 4/1968 | Salomon | 280/625 |
| 3,638,959 | 2/1972 | Renge | 280/625 |
| 3,902,730 | 9/1975 | Tschida et al. | 280/625 |

*Primary Examiner*—Robert R. Song

*Attorney, Agent, or Firm*—Blanchard, Flynn, Thiel, Boutell & Tanis

[57] ABSTRACT

This invention is an improvement over the structure illustrated in U.S. Pat. No. 3,902,730. The ski binding includes a pair of pivoted sole holders pivotal about axles which are fixed to the ski. The sole holders each have two arms, one of which engages the ski boot adjacent the toe thereof and the other arm engaging a structural part which is under spring tension, which spring tension must be overcome in order to effect a release of the ski boot from the ski. Structure is provided to interrupt the transfer of force of the ski boot acting on the spring intermediate the travel of the particular sole holder so that a decrease in the force resisting movement of the ski boot occurs and the ski boot can be freely removed from engagement with the ski.

12 Claims, 10 Drawing Figures

SKI BINDING PART

FIELD OF THE INVENTION

The invention relates to a ski binding part which has symmetrically arranged, two-arm sole holders, which are pivotal about ski-fixed axles which are arranged perpendicularly with respect to the running surface and which each rest with one arm on the boot and with the second arm rest on a structural part which is under the effect of a spring and is supported adjustably in the binding housing, wherein the second arms of the sole holders are held between the one end of a setscrew which is arranged in the housing and extends in longitudinal direction of the ski and a bent end of the structural part which is constructed as a slide, which with its other also bent end forms a support for the spring member, and wherein the other end of the setscrew is provided in the are of the housing, which area does not face the sole holder.

BACKGROUND OF THE INVENTION

This known ski binding part according to Austrian Pat. No. 321,170 (corresponds to U.S. Pat. No. 3,902,730) has proven to be successful in practice. However, it is disadvantageous only in the circumstance that the boot sole is supported during the entire release operation on the associated sole holder and thus has to overcome a resistance up to the final release.

Ski binding parts are already known in which after reaching a predetermined limit, which is generally identified as the elasticity limit, the movable ski binding part is swung or moved in its totality from the release area of the boot sole. This construction has, however, the disadvantage that the entire ski binding part must be moved so that the boot sole has to overcome an increased resistance at the limit of the elasticity.

The invention will aid and improve a ski binding part of the abovementioned type so that after exceeding the elasticity limit, the release force which is applied by the boot sole onto the loaded sole holder is reduced substantially, if necessary, is totally cancelled so that the entire movable ski binding part does not need to be operated.

The objects are inventively attained by providing within the range of movement of the slide member or the sole holders a tripping point, an exceeding of which effects a decrease in the force which is produced by the spring.

Through the inventive construction, after exceeding the elasticity limit, the force which is applied by the boot sole onto the operated sole holder is cancelled either totally, namely by preventing the transfer of force provided between the sole holder and the spring or by at least a substantial reduction in the spring force because the direction of the force vector which comes from the sole holder is changed in relationship to the force vector which is produced by the spring.

A preferable embodiment of the invention for interrupting the transfer of force consists in designing the slide member in two parts, wherein the part which is associated with the spring has at least one recess into which releasably projects the end of the second part which is designed as a carrier, which end is remote from the sole holders, and by arranging below the divided slide member a stop having a guide surface thereon which effects a sliding of the carrier out of the recess.

The two-part construction of the slide member can be carried out without any additional disadvantages; the interruption of the transfer of force by using a guide surface is positive and simple.

To effect a resetting or return of the carrier, same can be loaded inventively by a return spring. To set different elasticity limits according to a further embodiment of the invention, the stop can be shifted parallel with respect to the longitudinal extent of the slide member in the binding housing and can be locked in these positions.

A further inventive development consists of the carrier having a stop in the area of the recess which guides the carrier on its resetting path into the recess. This construction is particularly advantageous if the line of application of the return spring defines with the horizontal plane a relatively small angle because in this case the force component which moves the carrier into the recess is small. To increase the safe return, according to a further development of the invention, the stop can have a guide surface which extends sloped upwardly.

In a different embodiment of the invention, a particularly advantageous solution is that each sole holder is designed in two parts and the two parts are operatively connected through a carrier which is supported rotatably and/or pivotally on one of the sole holder parts. This construction permits an interruption of the force transfer between the two sole holder parts.

Two types of construction of the carrier exist within the scope of the invention. The first construction is characterized by the carrier being supported on the sole holder part which is associated with the ski boot sole and is loaded by a torsion spring which is also wound around the joint connecting the two sole holder parts and is suspended with its other end in the sole holder part associated with the slide member, furthermore by the carrier being supported with its free end on an abutment of this sole holder part. In this case the power flow is cancelled in totality after reaching the elasticity limit between the sole holder part which is associated with the boot sole and the sole holder part which is associated with the spring. This is inventively effected by arrangement transversely to the slide member a plate having guide surfaces along which the carriers move during the release operation, wherein the two ends of the plate form the tripping points, viewed in lateral direction of movement of the two carriers.

In a different, also inventive embodiment, the carrier forms partly a part of the sole holder part which is associated with the boot sole and carries on same a guide element, which is supported on a guide surface which is arranged on a stop which is secured in a ski-fixed part of the ski binding. In this embodiment, after reaching the elasticity limit, the direction of the force vector, which is produced by the sole holder part which is associated with the boot sole, is changed in relationship to the line of application of the spring. This is achieved according to a further characteristic of the invention by the guide surface of the stop having two guideway parts, the tangent or tangents of which define with the longitudinal axis of the ski binding part preferably two different angles, namely a support angle and a guide angle, and by the two guideway parts containing at their common line of intersection the tripping point.

It has been found to be particularly advantageous if the guide element, as actually known, is a roller.

BRIEF DESCRIPTION OF THE DRAWINGS

Further advantages and details of the invention will be recognized from reading the following description which sets forth several exemplary embodiments and with reference to the drawings.

In the drawings:

FIGS. 1 and 2 illustrate in related views a first exemplary embodiment of the invention wherein FIG. 1 is a longitudinal cross-sectional view taken along the line I—I of FIG. 2 and FIG. 2 is a top view of FIG. 1, FIG. 2 having incorporated therein a FIG. 2*a* which is a partial cross-sectional view a FIG. 2*b* which is a top view, these two illustrations serving to show the different positions of the ski binding part;

FIGS. 7 and 8 illustrate in associated views a second exemplary embodiment wherein FIG. 7 is a longitudinal sectional view taken along the line VII—VII of FIG. 8 and FIG. 8 is a top view having incorporated therein two half views, namely FIGS. 8*a* and 8*b* which, similar to FIGS. 2*a* and 2*b*, serve to illustrate two different positions of the ski binding part; and FIGS. 9 and 10 illustrate a third exemplary embodiment wherein FIG. 9 is a longitudinal sectional view taken along the line IX—IX of FIG. 10 and FIG. 10 includes two half views of FIGS. 10*a* and FIG. 10*b*, similar to FIGS. 2*a*, 2*b* and 8*a*, 8*b*.

DETAILED DESCRIPTION

Figure 1:
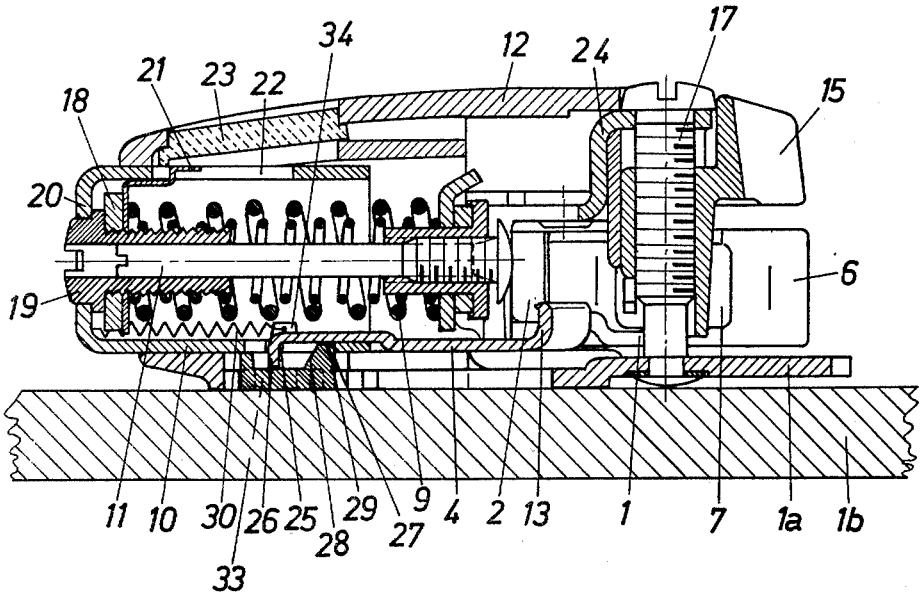

Identical and corresponding parts are identified in the description by the use of the same reference numerals; however, parts which have the same function and which are shaped differently, are identified with a prime (') suffix.

According to the first exemplary embodiment, a pair of two-arm bell-crank sole holders 1,2 are pivotally supported for movement about upstanding axles 3 secured to a base plate 1*a* which is in turn secured to a ski 1*b*. Each bell-crank sole holder has on its arm 1 which is adapted to engage the ski boot 8, which is illustrated in broken lines only in FIG. 2*b*, an approximate vertical axle 5 thereon on which a roller 7 is rotatably supported. A low friction material insert 6 is also pivotally supported on the axles 3. The insert has at its free end a rounded end functioning as a guide piece. The toe of the ski boot 8 engages and is held to the ski by the free end of the guide piece on the insert 6.

The normal position of the pair of sole holders 1,2 can, in this embodiment, be changed to accommodated various ski boot sole designs. As is shown in U.S. Pat. No. 3,902,730, the arms 2 of the sole holders project between a slide member 10, particularly the upwardly extending flange 13 thereon and a setscrew 11. The slide member 10 is under the effect of a spring 9 which urges it frontwardly away from the toe of the ski boot 8. By rotating the setscrew 11 in the binding housing 12, the sole holders 1,2 are, depending on the direction of rotation, pivoted into a wider or more narrow relative position.

Figure 2:
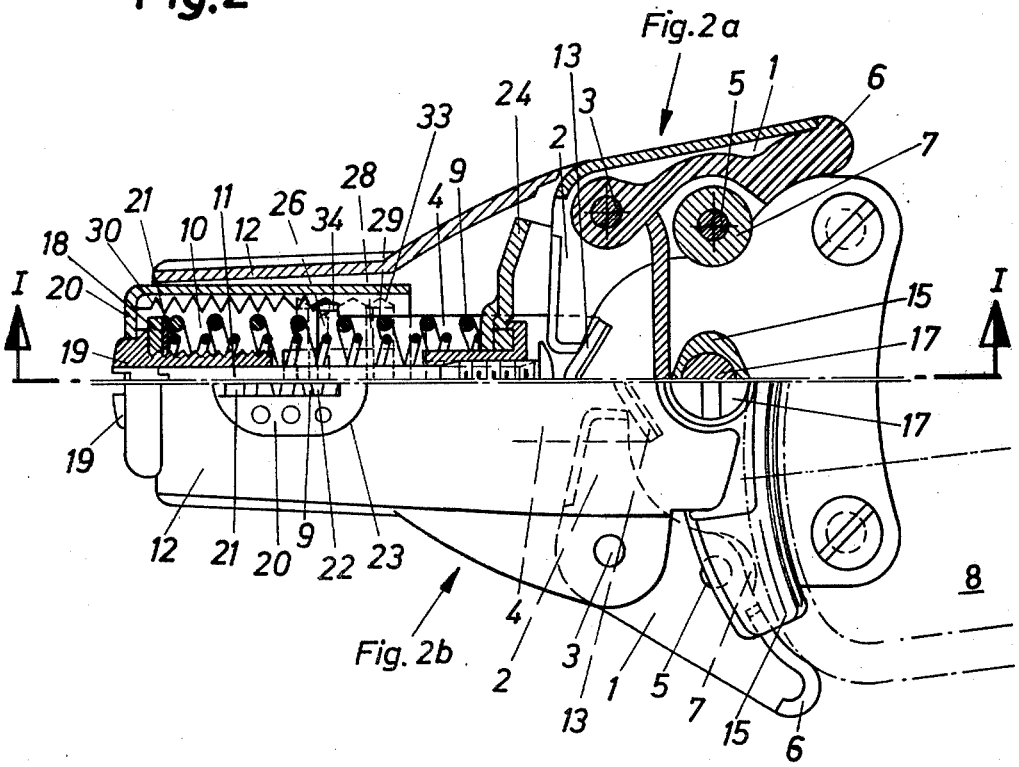
Figure 3:
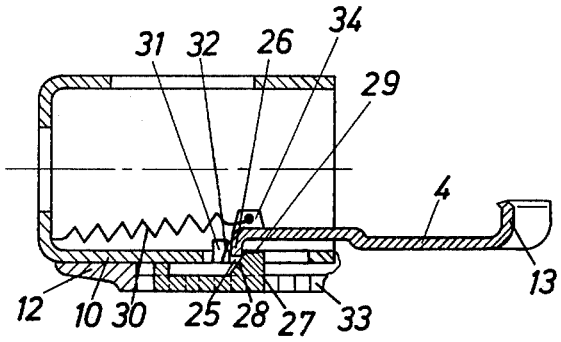
FIGS. 3, 4 and FIGS. 5, 6 illustrate associated views of the carrier in two different positions.
Figure 4:
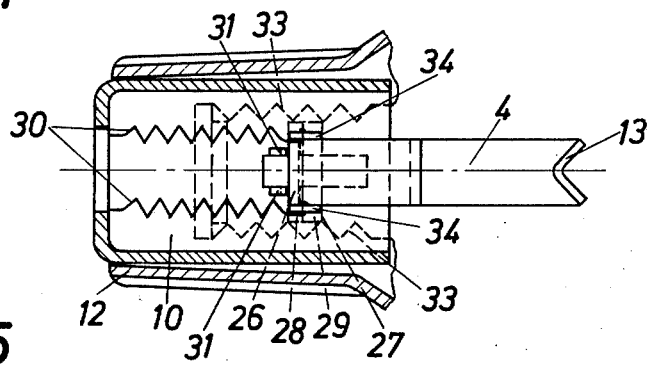

In contrast to the structure shown in U.S. Pat. No. 3,902,730, the slide member 10 in FIGS. 1 and 2 is constructed in two parts. The part which is still identified as a slide member 10 has a recess 25 therein into which releasably extends a downwardly bent tab 26 on a second slide member part which is formed as a carrier 4. The carrier 4 has in this embodiment on the end which faces the arms 2 of the sole holder a flange 13 which engages the arms 2. If the ski boot 8 is in fixed or secured condition in the ski binding part, then the necessary tension of the spring 9 is applied through the positive connection between the slide member 10 and the carrier 4 and flange 13 to the arms 2 of the two sole holders. If a force which loads the ski boot occurs and is greater than the adjusted force of the spring 9, the sole holder 1,2 which is associated with said force is pivoted about its axle 3 against the force of the spring 9. That is, the arm 2 pulls with it the flange 13 and thus the carrier 4 and through it and the aforesaid positive connection the slide member 10. The tab 26 projects into a guideway beneath the slide member 10 and carrier 4. In the path of rearward movement of the downwardly extending tab 26 of the carrier 4, there is arranged a stop 27 having an upwardly inclined guide surface 28 thereon. The guide surface 28 causes the tab 26 on the carrier 4 to move along the guide surface 28 upon reaching a predetermined position and also upon attaining an earlier determined elasticity limit to effect movement of the tab 26 away from the recess 25 at the tripping point 29 at the top of the guide surface 28 and at this moment cause a release of the slide member 10 which under the force of the spring 9 returns into the initial forward position. It will be understood that the tab 26 reaching the tripping point 29 means an interruption in the applied force existing between the sole holders 1,2 and the spring 9 so that the nonloaded sole holder 1,2 will freely pivot about their axles 3 to enhance the release of the ski boot 8 practically without any resistance.

To return the carrier 4, a return spring 30 is secured to and extends between the slide member 10 and the tab 26. The return spring 30, however, applies only a very small spring force to the sole holder which partakes in the release operation so that, as abovementioned, one can for all practical purposes speak of a release without resistance.

Figure 5:
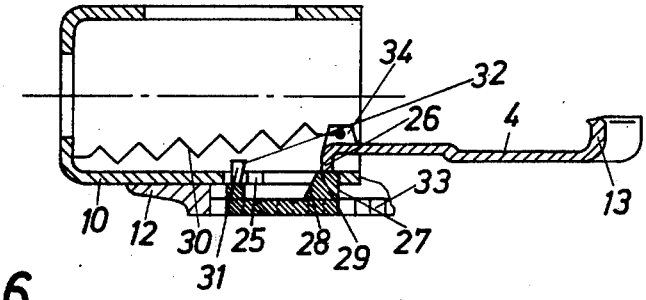
Figure 6:
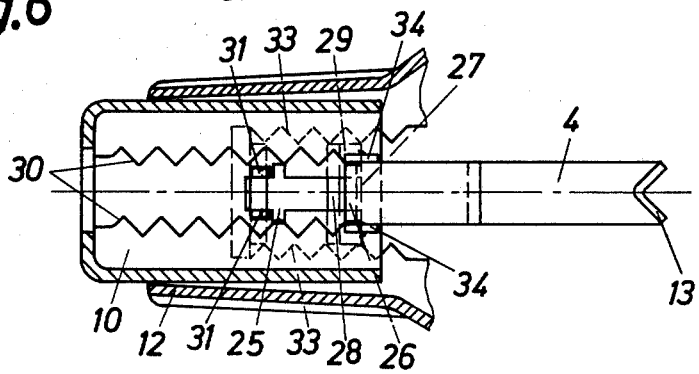

For a better illustration of the release operation, the details which are to be considered here have been illustrated in FIGS. 3, 4 and FIGS. 5, 6. FIGS. 3 and 4 or FIGS. 5 and 6 are thereby associated views. As can be recognized from FIGS. 3 and 4, the tab 26 of the carrier 4 moves planarly along the guide surface 28 of the stop 27 and the slide member 10 is also taken along. The return spring 30 is already tensioned. In the position according to FIGS. 5 and 6, the tab 26 of the carrier 4 is already above the stop 27 so that it is free from the recess 25 after which the slide member 10 is moved back under the force of the spring, here not illustrated, (compare spring 9 in FIGS. 1 and 2) into the initial forward position. The return spring 30 is still more tensioned. In this position the ski boot leaves the sole holder and the carrier 4 is returned into the initial position, namely the tab 26 is returned in the recess 25, under the return force of the spring 30. For the purpose of a better return, a stop 31 is provided above the recess 25, as is shown in FIG. 5. The stop may have, as also shown in FIG. 5, a guide surface 32 which is inclined upwardly in direction of the carrier 4. Since the flange 13 of the carrier 4 is loaded by the arms 2 of the sole holders, the recess 25 can have a certain clearance with respect to the tab 26 without creating a not permissible looseness in the ski binding part. The provided clearance is, on the other hand, preferable for a secure return of the tab 26 into the recess 25.

As can also be better taken from FIGS. 3 and 4 or FIGS. 5 and 6, the stop 27 can be moved in the binding housing 12 parallel with respect to the longitudinal extent of the slide member 10 and can be locked in these positions, preferably by means of saw-toothlike notches 33. Since the individual adjustment of the limit of the elasticity is necessary from skier to skier, this adjustment is advantageously carried out by the skilled installer of the ski binding part. For this reason, the stop 27 cannot be moved by the skier without disassembly of the ski binding part. As can also be recognized from these figures, two springs are used as return springs 30 and are connected or secured to mounting parts 34 on the one end which are secured to the carrier 4 and to the slide member 10 on the other end.

Figure 7:
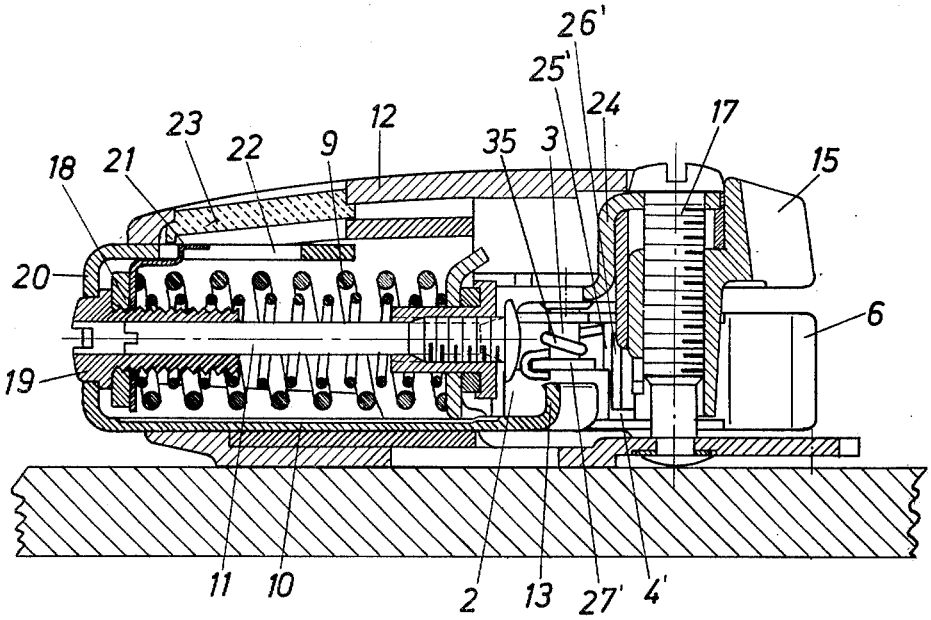
Figure 8:
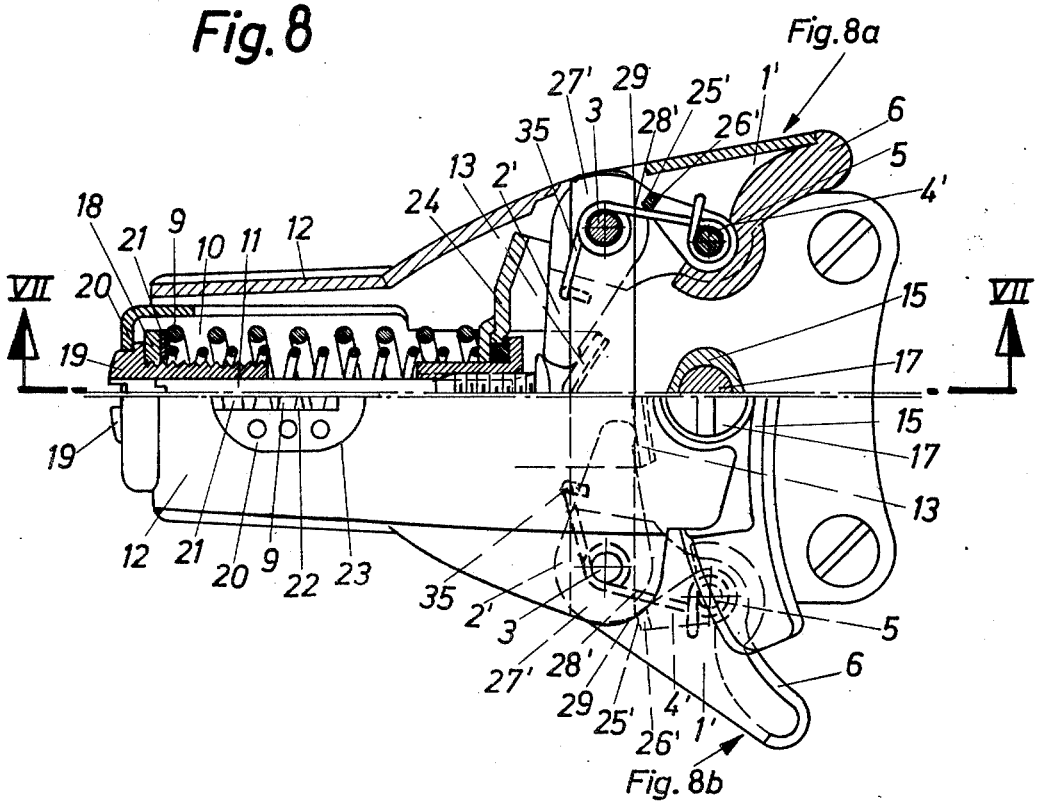

In the second exemplary embodiment according to FIGS. 7 and 8, the carrier 4' is designed as a swingable intermediate member which is inserted between the two arms 1',2' of the sole holder and which is pivotal about the axle 5. The free end 26' rests thereby on a stepped part 25' on the arm 2'. A carrier plate 27' is utilized as a stop in this exemplary embodiment and has guide surfaces 28' which are associated with the two carriers 4'. The plate 27' is thereby held on the two axles 3 and is, therefore, fixed to the ski. Each of the carriers 4' is loaded by one leg of a torsion spring 35 which is wound both around the holding axle 5 of the carrier 4' and also around the axle 3 of the arm 2' and is supported with its other end on the front edge of the plate 27'.

If an outside force now occurs which is greater than the force of the spring 9, then the appropriate one of the sole holders 1',2' is swung outwardly under the action of this outside force. The end 26' of the carrier 4' slides along the path 28' on the plate 27' to the tripping point 29. If the tripping point 29 is exceeded by the end 26' of the carrier 4', then the operative connection between the arms 1' and 2' is eliminated so that the boot 8 can slide out of the ski binding part without any resistance of the operated sole holder. Only to be complete it is remarked that here the slide member 10 is one piece, namely the structure of the ski binding part corresponds substantially to the design according to the aforementioned U.S. patent.

Figure 9:
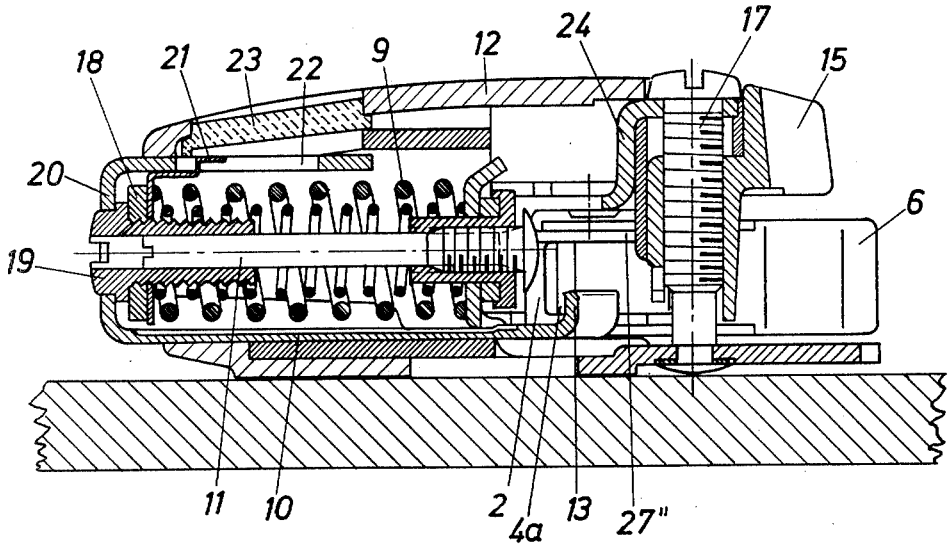
Figure 10:
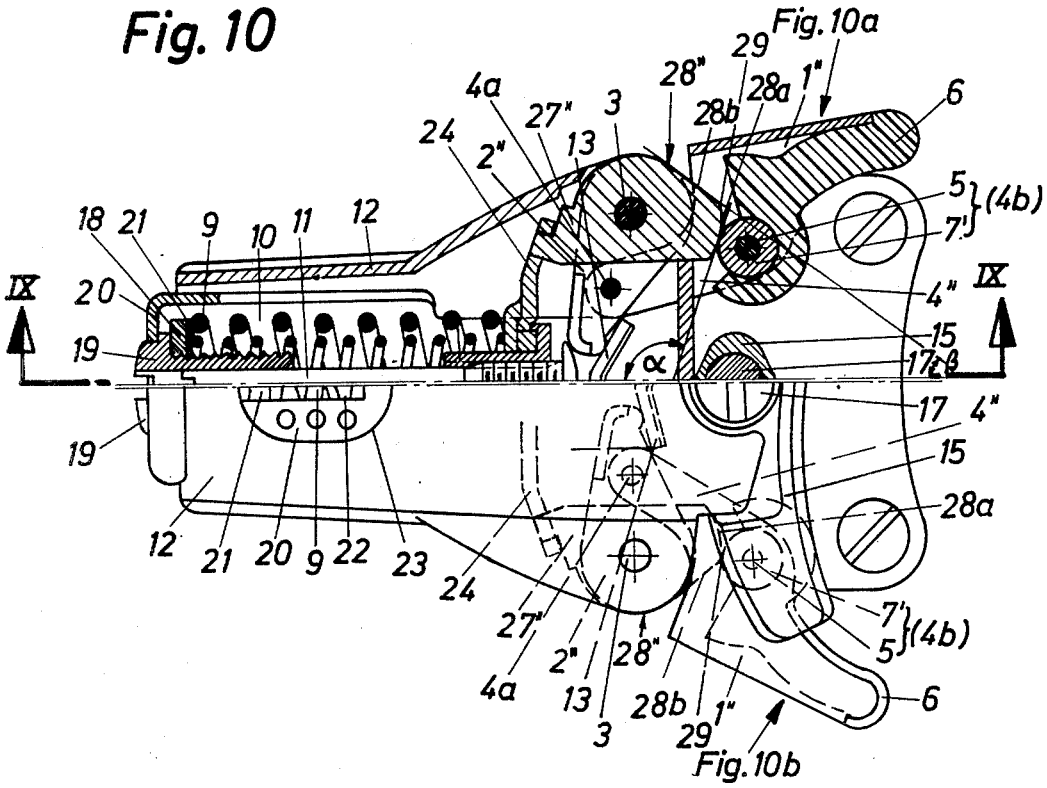

In the third exemplary embodiment according to FIGS. 9 and 10, the carrier 4'' is formed as a part of the arm 1'' which is associated with the boot 8 and has thereon a guide element which is formed as a roller 7' and is supported on the guide surface 28'' on a carrier or stop 27''. The stop 27'' is in this exemplary embodiment secured to a ski-fixed part of the ski binding. As can particularly be recognized from the FIG. 10*a* portion of FIG. 10, the carrier 4'' is a part of the arm 1'', however, with the further thought that in functional respect the hinged connection 4*a* and the guide element 7' belong also forcibly to the carrier 4''. It is not a requirement to design the guide element 7' in the form of a roller, however, this form of construction is preferred. Furthermore it can be recognized from FIG. 10, that the guide surface 28'' consists of two sections 28*a* and 28*b*. The two guide surface sections 28*a*, 28*b* or their tangent define with the longitudinal axis of the ski binding part preferably two different angles $\alpha$, $\beta$, namely one support angle $\alpha$ and a guide angle $\beta$, wherein the two guide surface sections 28*a*, 28*b* contain the tripping point 29 at their common line of intersection.

In all exemplary embodiments the further structure of the ski binding part corresponds substantially to the one according to the aforementioned U.S. patent. Therefore a holding means 15 can be utilized which is pivotally supported for movement about an axle 16 in the aforementioned U.S. patent which is provided in the binding housing 12 and can be adjusted in height to adjust to various boot sole thicknesses by means of the screw 17. Here too the spring 9 is supported at one end on the binding housing 12 and at the other end on the spring plate 18. The spring plate 18 is movable by the screw 19 in the slide member 10, however, it cannot be rotated. The screw 19 itself is supported in a bore of a bent section 20 of the slide member 10. By rotating the screw 19, the spring plate 18 moves changing the tension of the spring 9. To indicate the release force, the spring plate 18 forms a pointer or indicator 21 which is visible through a window 22 of the slide member 10.

By rotating the setscrew 11, the slide member 10 also moves in the one direction by compressing the spring 9, or in the other direction, by relaxing the spring 9. After the sole holders have been adjusted, the spring 9 can be adjusted to the proper value for the new location of the sole holders. In order to here also produce an indication of the position of the bell-crank sole holder, a representation of such is indicated in the window 22 of the slide member 10 which is provided below a further window 23 of a housing part 24. Thus it is possible to recognize on markings within the window 23 the side position of the sole holders and also within the window 22 an indication of the adjusted release force.

Finally it must be noted that the two-part views in FIG. 2 and in FIGS. 8 and 10, the half cross sections FIG. 2*b*, FIG. 8*b* and FIG. 10*b* each illustrate a position which corresponds with the limit of the elasticity, namely the tripping point.

The invention is not limited to the listed exemplary embodiments. Changes can be made without departing from the scope of the invention. In particular the design of the releasable carrier may be of a different kind, namely both when it lies in the area of the slide member and also when it lies in the area of the sole holder. It can be understood if for reducing friction parts are used which have good sliding or low friction characteristic or at least these areas consist of such a material or are provided with an insert or coating of this material. Should, for whatever reasons, a change be necessary in the course of the force which is to be overcome prior to the tripping point, then the course of the associated guide surface can be designed correspondingly.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski binding having a binding housing mounted on the upper surface of a ski comprising symmetrically arranged, two-arm sole holders pivotal between a sole holding position and a sole releasing position about ski-fixed axes which are arranged perpendicularly with respect to said upper surface and which each rest with one arm thereof on the sole of a ski boot and a second arm thereof rests on one end of a slide member movably supported in said binding housing, the other end of said slide member being operatively engaged with a spring adjustably supported in said binding housing, wherein the improvement comprises control means operatively connected to one of said slide member and said sole holders and defining a tripping point which becomes effective in response to a predetermined amount of movement of said sole holders toward said releasing position thereof to effect a decrease in the force which is produced by said spring and permit a resistance free movement of both of said sole holders to said released position thereof.

2. The improved ski binding part according to claim 1, wherein said control means comprises said slide member being constructed in two parts, wherein a first part is operatively connected to said spring and has at least one recess therein, a second part having a tab which releasably projects into said recess, and wherein below the two-part slide member there is arranged a stop having a guide surface which effects a sliding of said tab out of said recess.

3. The improved ski binding part according to claim 2, wherein said second part includes at least one return spring which is connected to and extends between said second part and said binding housing to effect a return of said tab to said recess following a release of said boot from said ski binding.

4. The improved ski binding part according to claim 2, wherein said stop is movably supported in said binding housing parallel with respect to the longitudinal extent of said slide member and locking means are provided for locking said stop in a selected and fixed position.

5. The improved ski binding part according to claim 2, wherein said first part has in the area of said recess a further stop for guiding said tab on its resetting path into said recess.

6. The improved ski binding part according to claim 5, wherein said further stop has a guide surface thereon which in direction of said second part extends sloped upwardly.

7. The improved ski binding part according to claim 1, wherein said control means comprises each of said sole holder being formed in two parts and carrier means operatively connecting said two parts to said ski-fixed axes.

8. The improved ski binding part according to claim 7, wherein said carrier means is supported on said sole holder part which is operatively connected with said ski boot and includes a torsion spring having two legs wherein said two parts of said sole holder are biased to a first relative position by said torsion spring which is wound around a joint which connects said two sole holder parts together, one of said two sole holder parts having an abutment surface engaged by a guide element mounted on the other of said two parts to cause said two parts to pivot together during movement through a predetermined range, the spring force of said spring being always greater than the force of said torsion spring to cause said two parts to move relative to each other.

9. The improved ski binding part according to claim 8, wherein said control means includes a plate having guide surfaces along which moves said guide element during the release operation, said plate being arranged transversely with respect to said slide member, wherein the two ends of the plate, viewed in lateral direction of movement of said two members, form said tripping points after which said sold holder is permitted to move freely.

10. The improved ski binding part according to claim 7, wherein said carrier means forms a part of said sole holder part which is operatively engaged with said boot sole and carries a guide element on said sole holder part, said guide element being supported on a guide surface, which is arranged on a stop which is secured in a ski-fixed part of the ski binding.

11. The improved ski binding part according to claim 10, wherein said guide element is a roller.

12. The improved ski binding part according to claim 10, wherein said guide surface on said stop has two guideway parts, the tangents of which define with the longitudinal axis of the ski binding part preferably two different angles ($\alpha$,$\beta$), namely a support angle ($\alpha$) and a guide angle ($\beta$), and wherein said two guideway parts define in their common line of intersection said tripping point.

* * * * *